US009522453B2

(12) United States Patent
Aizawa et al.

(10) Patent No.: US 9,522,453 B2
(45) Date of Patent: Dec. 20, 2016

(54) POLISHING APPARATUS

(71) Applicant: EBARA CORPORATION, Tokyo (JP)

(72) Inventors: Hideo Aizawa, Tokyo (JP); Masao Umemoto, Tokyo (JP); Tadakazu Sone, Tokyo (JP); Ryuichi Kosuge, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 14/792,062

(22) Filed: Jul. 6, 2015

(65) Prior Publication Data

US 2016/0008948 A1 Jan. 14, 2016

(30) Foreign Application Priority Data

Jul. 9, 2014 (JP) ..... 2014-141732

(51) Int. Cl.
*B24B 37/015* (2012.01)
*B24B 37/10* (2012.01)
*B24B 37/04* (2012.01)

(52) U.S. Cl.
CPC ..... *B24B 37/015* (2013.01); *B24B 37/04* (2013.01); *B24B 37/107* (2013.01)

(58) Field of Classification Search
CPC ..... B24B 37/015; B24B 37/04; B24B 37/107; B24B 41/06; B24B 55/02; B24B 57/00; B24B 57/02
See application file for complete search history.

(56) References Cited

U.S. PATENT DOCUMENTS 5,303,959 A * 4/1994 Medsker ..... F16L 27/0828 285/121.5
5,797,789 A * 8/1998 Tanaka ..... B24B 37/04 451/205
6,123,606 A * 9/2000 Hill ..... B24B 1/00 451/178
6,126,207 A * 10/2000 Ives ..... F16L 39/04 285/121.1
6,145,889 A * 11/2000 Imai ..... F16L 27/0816 285/111
6,189,427 B1 * 2/2001 Kosho ..... B23B 3/06 29/35.5

(Continued)

FOREIGN PATENT DOCUMENTS

JP 10-235552 A 9/1998
JP 2000177984 A * 6/2000
JP 2007-222965 A 9/2007

*Primary Examiner* — Timothy V Eley
(74) *Attorney, Agent, or Firm* — Pearne & Gordon LLP

(57) ABSTRACT

A polishing apparatus which can continue stable operation of the apparatus without generating torsional vibration in a rotary joint and without generating an abnormal sound at an engagement part between a cooling water pipe and a polishing table is disclosed. The polishing apparatus includes a rotary joint fixed to a rotating part of the polishing table or a rotating part of the top ring to supply a fluid into the polishing table or the top ring and discharge the fluid from the polishing table or the top ring, and a rotation-prevention mechanism which connects the rotary joint with an apparatus frame to prevent the rotary joint from being rotated. The rotation-prevention mechanism includes a link mechanism having at least one spherical plain bearing.

6 Claims, 9 Drawing Sheets

(56) References Cited

U.S. PATENT DOCUMENTS

| | | | | |
|---|---|---|---|---|
| 6,234,815 | B1 * | 5/2001 | Omiya | B24B 37/04 439/191 |
| 6,402,602 | B1 * | 6/2002 | Garcia | B24B 37/04 451/287 |
| 6,435,949 | B1 * | 8/2002 | Katsuoka | B24B 37/30 451/288 |
| 7,083,506 | B2 * | 8/2006 | Torii | B24B 37/04 451/285 |
| 8,202,140 | B2 * | 6/2012 | Hong | B24B 57/00 451/288 |
| 2004/0053559 | A1 * | 3/2004 | Torii | B24B 37/20 451/5 |
| 2015/0017889 | A1 * | 1/2015 | Umemoto | B08B 1/002 451/73 |
| 2015/0118944 | A1 * | 4/2015 | Kosuge | B24B 45/006 451/287 |
| 2015/0290769 | A1 * | 10/2015 | Aizawa | B24B 37/10 451/259 |

* cited by examiner

POLISHING APPARATUS

CROSS REFERENCE TO RELATED APPLICATION

This document claims priority to Japanese Patent Application Number 2014-141732 filed Jul. 9, 2014, the entire contents of which are hereby incorporated by reference.

BACKGROUND

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles, such as silica ($SiO_2$), ceria ($CeO_2$) or the like, therein is supplied onto a polishing surface of a polishing pad, a substrate such as a semiconductor wafer is brought into sliding contact with the polishing surface and polished by using a polishing apparatus.

The polishing apparatus which performs the above-mentioned CMP process includes a polishing table having a polishing surface, and a polishing head (top ring) for holding a substrate such as a semiconductor wafer. When the substrate is polished with such a polishing apparatus, the substrate is held and pressed against the polishing surface under a predetermined pressure by the polishing head. At this time, while a polishing liquid is supplied onto the polishing surface, the polishing table and the polishing head are respectively rotated to bring the substrate into sliding contact with the polishing surface, so that the surface of the substrate is polished to a flat mirror finish.

A polishing rate of the surface, being polished, of the substrate depends not only on a polishing load on the substrate against the polishing pad but also on a surface temperature of the polishing surface. This is because a chemical action of the polishing liquid on the substrate depends on a temperature. Therefore, in manufacturing of the semiconductor device, in order to increase the polishing rate of the surface, being polished, of the substrate and further to keep the polishing rate constant, it is considered to be important to keep the surface temperature of the polishing surface during polishing of the substrate at an optimum value.

Therefore, conventionally, a fluid passage for heat exchange medium is provided in the interior of the polishing table and cooling water serving as the heat exchange medium is flowed in the fluid passage to exchange heat between the heat exchange medium and the polishing table.

Thus, thermal deformation of the polishing table due to frictional heat during polishing is prevented and the surface temperature of the polishing surface on the polishing table is adjusted.

As described above, since the polishing table is rotated, the cooling water needs to be delivered into the interior of the rotating polishing table. Therefore, a rotary joint is provided on the polishing table, and the cooling water is supplied from the outside into the fluid passage in the polishing table through a cooling water pipe and the rotary joint to perform heat exchange in the polishing table, and is then discharged to the outside. The cooling water which has been discharged to the outside is cooled in a chiller unit, and is supplied into the polishing table again (see Japanese Laid-open Patent Publication No. 10-235552).

However, torsional vibration is generated in the rotary joint or an abnormal sound is generated at an engagement part between the cooling water pipe and the polishing table depending on installation environment or operating condition (e.g. at the time of low-speed idling) of the polishing apparatus. If the operation of the polishing apparatus is continued under this circumstance, a fatigue failure of the above-mentioned parts provided in the cooling water supply passage may be caused or the pipes may be damaged due to sliding wear, possibly leading to leakage of the cooling water.

SUMMARY OF THE INVENTION

According to an embodiment, there is provided a polishing apparatus which can continue stable operation of the apparatus without generating torsional vibration in a rotary joint and without generating an abnormal sound at an engagement part between a cooling water pipe and a polishing table.

Embodiments, which will be described below, relate to a polishing apparatus for polishing and planarizing a substrate such as a semiconductor wafer.

In an embodiment, there is provided a polishing apparatus for polishing a substrate by pressing the substrate against a polishing surface on a polishing table by a top ring while rotating the top ring holding the substrate and rotating the polishing table, the polishing apparatus comprising: a rotary joint fixed to a rotating part of the polishing table or a rotating part of the top ring to supply a fluid into the polishing table or the top ring and discharge the fluid from the polishing table or the top ring; and a rotation-prevention mechanism which connects the rotary joint with an apparatus frame to prevent the rotary joint from being rotated; wherein the rotation-prevention mechanism comprises a link mechanism having at least one spherical plain bearing.

According to the embodiment, the rotary joint for supplying the fluid into the polishing table or the top ring and discharging the fluid from the polishing table or the top ring is fixed to the apparatus frame by the link mechanism having at least one spherical plain bearing. With this configuration, the rotary joint is prevented from being rotated and is supported by the apparatus frame. Further, a vibration phenomenon due to stick-slip generated on a seal contact surface between a stationary ring and a rotary ring in the rotary joint can be absorbed or lessened by a micro rotational movement in all directions (360°) of the at least one spherical plain bearing.

In an embodiment, the link mechanism comprises two spherical plain bearings which are connected to each other.

According to the embodiment, since the link mechanism is configured by connecting the two spherical plain bearings, the micro rotational movement in all directions (360°) about each of the centers of the two spherical plain bearings can be made. Further, by arranging axes of the two spherical plain bearings so as to be perpendicular to each other, the centers of the rotational movements of the two spherical plain bearings differ in phase by 90°, and thus the degree of freedom of the movement is increased.

In an embodiment, one of the two spherical plain bearings comprises a spherical plain bearing with male thread, and the other of the two spherical plain bearings comprises a spherical plain bearing with female thread, and the two spherical plain bearings are integrated by screw fastening.

In an embodiment, the rotation-prevention mechanism comprises the link mechanism, a rotation-prevention plate configured to connect the link mechanism with the rotary joint, and a stopper plate configured to connect the link mechanism with the apparatus frame.

In an embodiment, the link mechanism is coupled to the rotary joint to increase a natural frequency of the rotary joint, whereby the natural frequency of the rotary joint is different from a natural frequency of a rotating member of the polishing table or a rotating member of the top ring.

According to the embodiment, by connecting the link mechanism with the rotary joint, a rotary joint assembly which integrates the rotary joint and the link mechanism has an increased natural frequency which is significantly different from natural frequencies of other peripheral parts. Therefore, resonance between the rotary joint assembly, which integrates the rotary joint and the link mechanism, and the peripheral parts such as a cooling water pipe can be prevented. As a result, the torsional vibration of the rotary joint can be prevented, and the pipe wear and the generation of the abnormal sound can be prevented.

In an embodiment, the rotating member comprises a cooling water pipe configured to supply cooling water into the polishing table or to discharge the cooling water from the polishing table.

According to the above-described embodiments, stable operation of the apparatus can be continued without generating the torsional vibration in the rotary joint and without generating the abnormal sound at the engagement part between the cooling water pipe and the polishing table.

BRIEF DESCRIPTION OF THE DRAWINGS

FIG. 7A is a cross-sectional view showing the spherical plain bearing with female thread and FIG. 7B is a cross-sectional view showing the spherical plain bearing with male thread;

DESCRIPTION OF EMBODIMENTS

Figure 1:
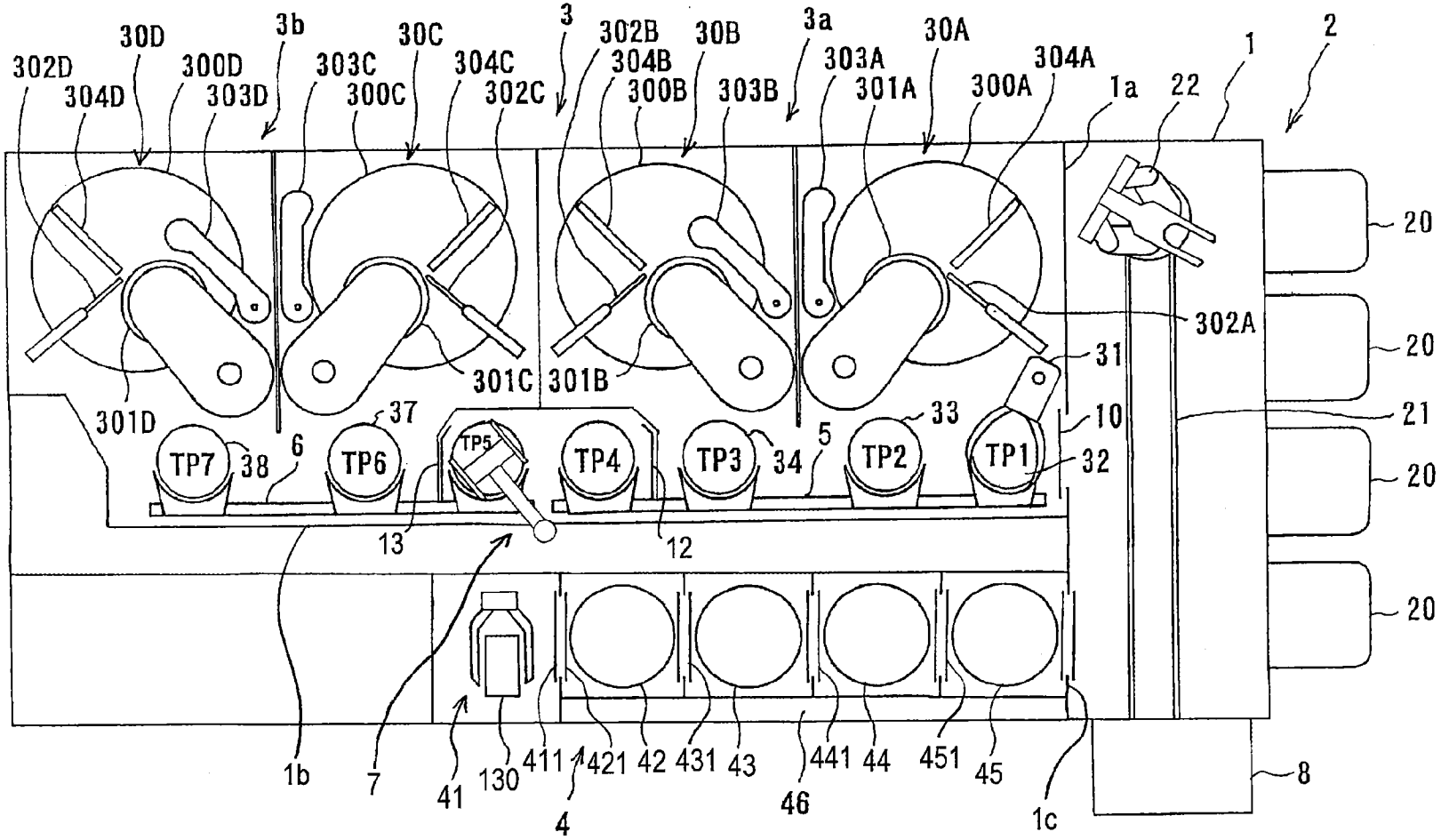
FIG. 1 is a plan view showing an entire structure of a polishing apparatus according to an embodiment.

A polishing apparatus according to an embodiment will be described below with reference to FIGS. 1 through 9. Like or corresponding parts are denoted by like or corresponding reference numerals in FIGS. 1 through 9 and will not be described below repetitively. In this embodiment, a semiconductor wafer will be described as a substrate to be polished.

FIG. 1 is a plan view showing an entire structure of a polishing apparatus according to the embodiment. As shown in FIG. 1, the polishing apparatus according to the embodiment has a housing 1 in a generally-rectangular shape. An interior space of the housing 1 is divided into a loading/unloading section 2, a polishing section 3 (3*a*, 3*b*), and a cleaning section 4 by partition walls 1*a*, 1*b* and 1*c*. The loading/unloading section 2, the polishing sections 3*a*, 3*b*, and the cleaning section 4 are assembled independently of each other, and air is discharged from these sections independently of each other.

The loading/unloading section 2 has two or more (four in this embodiment) front loading units 20 on which wafer cassettes, each storing plural semiconductor wafers, are placed. The front loading units 20 are arranged adjacent to each other along a width direction of the polishing apparatus (a direction perpendicular to a longitudinal direction of the polishing apparatus). Each of the front loading units 20 is capable of receiving thereon an open cassette, a SMIF (Standard Manufacturing Interface) pod, or a FOUP (Front Opening Unified Pod). The SMIF and FOUP are a hermetically sealed container which houses a wafer cassette therein and is covered with a partition to thereby provide an independent interior environment isolated from an external space.

Further, the loading/unloading section 2 has a moving mechanism 21 extending along an arrangement direction of the front loading units 20. A transport robot 22 is installed on the moving mechanism 21 and is movable along the arrangement direction of the wafer cassettes. The transport robot 22 is configured to move on the moving mechanism 21 so as to access the wafer cassettes mounted on the front loading units 20. The transport robot 22 has vertically arranged two hands, which can be separately used. For example, the upper hand is used for returning a semiconductor wafer to the wafer cassette, and the lower hand is used for transferring a semiconductor wafer before polishing.

The loading/unloading section 2 is required to be a cleanest area. Therefore, pressure in the interior of the loading/unloading section 2 is kept higher at all times than pressures in the exterior space of the polishing apparatus, the polishing section 3, and the cleaning section 4. A filter fan unit (not shown) having a clean air filter, such as a HEPA filter and a ULPA filter, is provided above the moving mechanism 21 of the transport robot 22. This filter fan unit removes particles, toxic vapor, and gas from air to produce clean air, and to form downward flow of the clean air at all times.

The polishing section 3 is an area where semiconductor wafers are polished. This polishing section 3 includes a first polishing section 3*a* having therein a first polishing unit 30A and a second polishing unit 30B, and a second polishing section 3*b* having therein a third polishing unit 30C and a fourth polishing unit 30D. The first polishing unit 30A, the second polishing unit 30B, the third polishing unit 30C, and the fourth polishing unit 30D are arranged along the longitudinal direction of the polishing apparatus as shown in FIG. 1.

As shown in FIG. 1, the first polishing unit 30A includes a polishing table 300A having a polishing pad (polishing surface), a top ring 301A for holding a semiconductor wafer and pressing the semiconductor wafer against the polishing pad on the polishing table 300A to polish the semiconductor wafer, a polishing liquid supply nozzle 302A for supplying a polishing liquid and a dressing liquid (e.g., water) onto the polishing pad on the polishing table 300A, a dressing apparatus 303A for dressing the polishing pad on the polishing table 300A, and an atomizer 304A for ejecting a mixed fluid of a liquid (e.g., pure water) and a gas (e.g., nitrogen gas) or a liquid (e.g., pure water) in an atomized state onto the polishing pad from one or plural nozzles. Similarly, the second polishing unit 30B includes a polishing table 300B, a top ring 301B, a polishing liquid supply nozzle 302B, a dressing apparatus 303B, and an atomizer 304B. The third polishing unit 30C includes a polishing table 300C, a top ring 301C, a polishing liquid supply nozzle 302C, a dressing apparatus 303C, and an atomizer 304C. The fourth polishing unit 30D includes a polishing table 300D, a top ring 301D, a polishing liquid supply nozzle 302D, a dressing apparatus 303D, and an atomizer 304D.

A first linear transporter 5 is provided between the first polishing unit 30A and the second polishing unit 30B in the first polishing section 3*a*, and the cleaning section 4. This first linear transporter 5 is configured to transfer wafers between four transferring positions located along the longitudinal direction of the polishing apparatus (hereinafter, these four transferring positions will be referred to as a first transferring position TP1, a second transferring position TP2, a third transferring position TP3, and a fourth transferring position TP4 in the order from the loading/unloading section 2). A reversing machine 31 for reversing a wafer received from the transport robot 22 in the loading/unloading section 2 is disposed above the first transferring position TP1 of the first linear transporter 5. A vertically movable lifter 32 is disposed below the reversing machine 31. A vertically movable pusher 33 is disposed below the second transferring position TP2, and a vertically movable pusher 34 is disposed below the third transferring position TP3. A shutter 12 is provided between the third transferring position TP3 and the fourth transferring position TP4.

In the second polishing section 3*b*, a second linear transporter 6 is provided next to the first linear transporter 5. This second linear transporter 6 is configured to transfer wafers between three transferring positions located along the longitudinal direction of the polishing apparatus (hereinafter, these three transferring positions will be referred to as a fifth transferring position TP5, a sixth transferring position TP6, and a seventh transferring position TP7 in the order from the loading/unloading section 2). A pusher 37 is disposed below the sixth transferring position TP6 of the second linear transporter 6, and a pusher 38 is disposed below the seventh transferring position TP7 of the second linear transporter 6. A shutter 13 is provided between the fifth transferring position TP5 and the sixth transferring position TP6.

As can be understood from the fact that a slurry is used during polishing, the polishing section 3 is the dirtiest area. Therefore, in order to prevent particles from spreading out of the polishing section 3, evacuation is conducted from surrounding spaces of the respective polishing tables in this embodiment. In addition, pressure in the interior of the polishing section 3 is set to be lower than any of pressure outside the apparatus, pressure in the cleaning section 4, and pressure in the loading/unloading section 2, so that scattering of the particles is prevented. Typically, exhaust ducts (not shown) are provided below the polishing tables, respectively, and filters (not shown) are provided above the polishing tables, so that downward flows of cleaned air are formed through the filters and the exhaust ducts.

The polishing units 30A, 30B, 30C and 30D are each partitioned and closed by a partition wall, and the air is exhausted individually from each of the closed polishing units 30A, 30B, 30C and 30D. Thus, a semiconductor wafer can be processed in the closed polishing unit 30A, 30B, 30C or 30D without being influenced by the atmosphere of a slurry. This enables good polishing of the wafers. As shown in FIG. 1, the partition walls between the polishing units 30A, 30B, 30C and 30D have respective openings for passage of the linear transporters 5, 6. It is also possible to provide each opening with a shutter, and to open the shutter only when a wafer passes through the opening.

The cleaning section 4 is an area where polished semiconductor wafers are cleaned. The cleaning section 4 includes a reversing machine 41 for reversing a semiconductor wafer, four cleaning apparatuses 42, 43, 44 and 45 each for cleaning the polished semiconductor wafer, and a transferring unit 46 for transferring wafers between the reversing machine 41 and the substrate cleaning apparatuses 42, 43, 44 and 45. The reversing machine 41 and the substrate cleaning apparatuses 42, 43, 44 and 45 are arranged in series along the longitudinal direction of the polishing apparatus. A filter fan unit (not shown), having a clean air filter, is provided above the substrate cleaning apparatuses 42, 43, 44 and 45. This filter fan unit is configured to remove particles from air to produce clean air, and to form downward flow of the clean air at all times. Pressure in the interior of the cleaning section 4 is kept higher at all times than pressure in the polishing section 3, so that particles in the polishing section 3 are prevented from flowing into the cleaning section 4.

As shown in FIG. 1, a swing transporter (wafer transferring mechanism) 7 is provided between the first linear transporter 5 and the second linear transporter 6, for transferring a wafer between the first linear transporter 5, the second linear transporter 6, and the reversing machine 41 of the cleaning section 4. The swing transporter 7 is configured to transfer a wafer from the fourth transferring position TP4 of the first linear transporter 5 to the fifth transferring position TP5 of the second linear transporter 6, from the fifth transferring position TP5 of the second linear transporter 6 to the reversing machine 41, and from the fourth transferring position TP4 of the first linear transporter 5 to the reversing machine 41, respectively.

Figure 2:
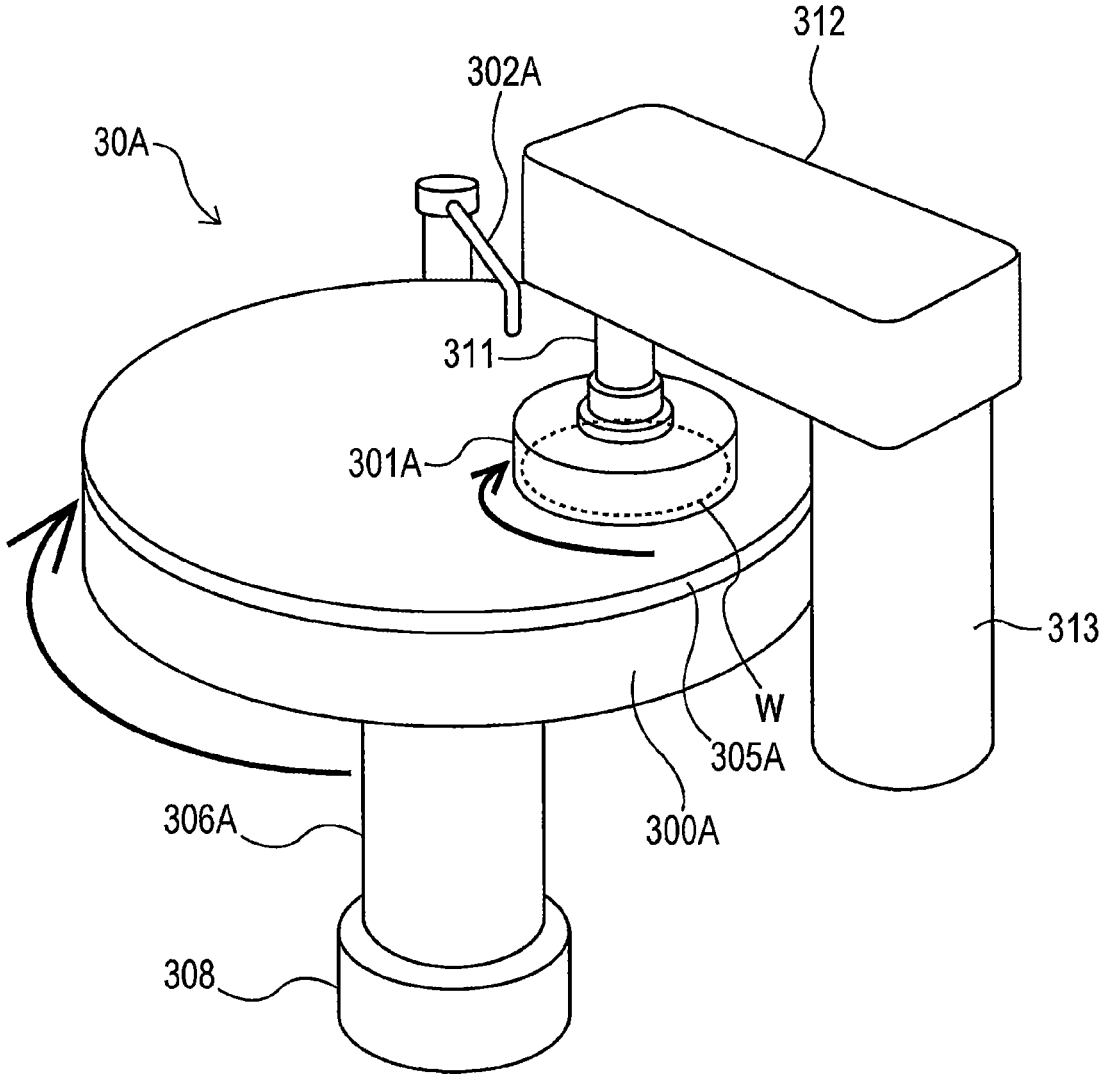
FIG. 2 is a schematic perspective view showing an entire structure of a first polishing unit of four polishing units shown in FIG. 1.

FIG. 2 is a schematic perspective view showing an entire structure of the first polishing unit 30A of the four polishing units shown in FIG. 1. Other polishing units 30B, 30C and 30D have the same structure as the first polishing unit 30A. As shown in FIG. 2, the first polishing unit 30A comprises a polishing table 300A, and a top ring 301A for holding a semiconductor wafer W as an object to be polished and pressing the wafer against a polishing pad 305A on the polishing table. The polishing table 300A is coupled to a hollow table shaft 306A. The table shaft 306A is coupled to a polishing table rotating motor (not shown). Thus, the polishing table 300A is rotatable integrally with the table shaft 306A. A polishing pad 305A is attached to an upper surface of the polishing table 300A. The surface of the polishing pad 305A constitutes a polishing surface for polishing the semiconductor wafer. The polishing pad 305A comprising SUBA 800, IC-1000, IC-1000/SUBA400 (two-layer cloth), or the like manufactured by Rodel Holdings, Inc. is used. The SUBA 800 is non-woven fabrics bonded by urethane resin. The IC-1000 comprises a pad composed of hard polyurethane foam and having a large number of fine holes formed in its surface, and is also called a perforated pad. A polishing liquid supply nozzle 302A is provided above the polishing table 300A to supply a polishing liquid (slurry) onto the polishing pad 305A on the polishing table 300A.

In the interior of the polishing table 300A, a fluid passage (not shown) for heat exchange medium is provided. Cooling water serving as the heat exchange medium is flowed in the fluid passage to exchange heat between the heat exchange medium and the polishing table 300A. Thus, thermal deformation of the polishing table 300A due to frictional heat during polishing is prevented and a surface temperature of the polishing surface on the polishing table is adjusted. Therefore, as shown in FIG. 2, a rotary joint 308 is provided on a lower end portion of the table shaft 306A, and the cooling water is supplied from the outside into the fluid passage provided in the polishing table through a cooling water pipe (not shown) and the rotary joint 308.

The top ring 301A is connected to a top ring shaft 311, and the top ring shaft 311 is vertically movable with respect to a support arm 312. When the top ring shaft 311 moves vertically, the top ring 301A is lifted and lowered as a whole for positioning with respect to the support arm 312. The top ring shaft 311 is configured to be rotated by driving a top ring rotating motor (not shown). The top ring 301A is rotated about the top ring shaft 311 by rotation of the top ring shaft 311.

The top ring 301A is configured to hold the semiconductor wafer W on its lower surface. The support arm 312 is configured to be pivotable about a shaft 313, thereby swinging the top ring 301A to a wafer transferring position (pusher 33). In the wafer transferring position, the semiconductor wafer, which has been transferred to the pusher 33 (see FIG. 1), is held under vacuum by the top ring 301A. Thus, the top ring 301A, which holds the semiconductor wafer on its lower surface, is movable from the wafer transferring position (pusher 33) to a position above the polishing table 300A by pivotable movement of the support arm 312. Then, the top ring 301A holds the semiconductor wafer on its lower surface and presses the semiconductor wafer against the surface of the polishing pad 305A. At this time, while the polishing table 300A and the top ring 301A are respectively rotated, a polishing liquid (slurry) is supplied onto the polishing pad 305A from the polishing liquid supply nozzle 302A provided above the polishing table 300A. The polishing liquid containing silica ($SiO_2$) or ceria ($CeO_2$) as abrasive particles is used. A polishing step by the first polishing unit 30A is performed as follows: While the polishing liquid is supplied onto the polishing pad 305A, the semiconductor wafer is pressed against the polishing pad 305A by the top ring 301A, and the semiconductor wafer and the polishing pad 305A are moved relative to each other, thereby polishing an insulating film, a metal film or the like on the semiconductor wafer.

Figure 3:
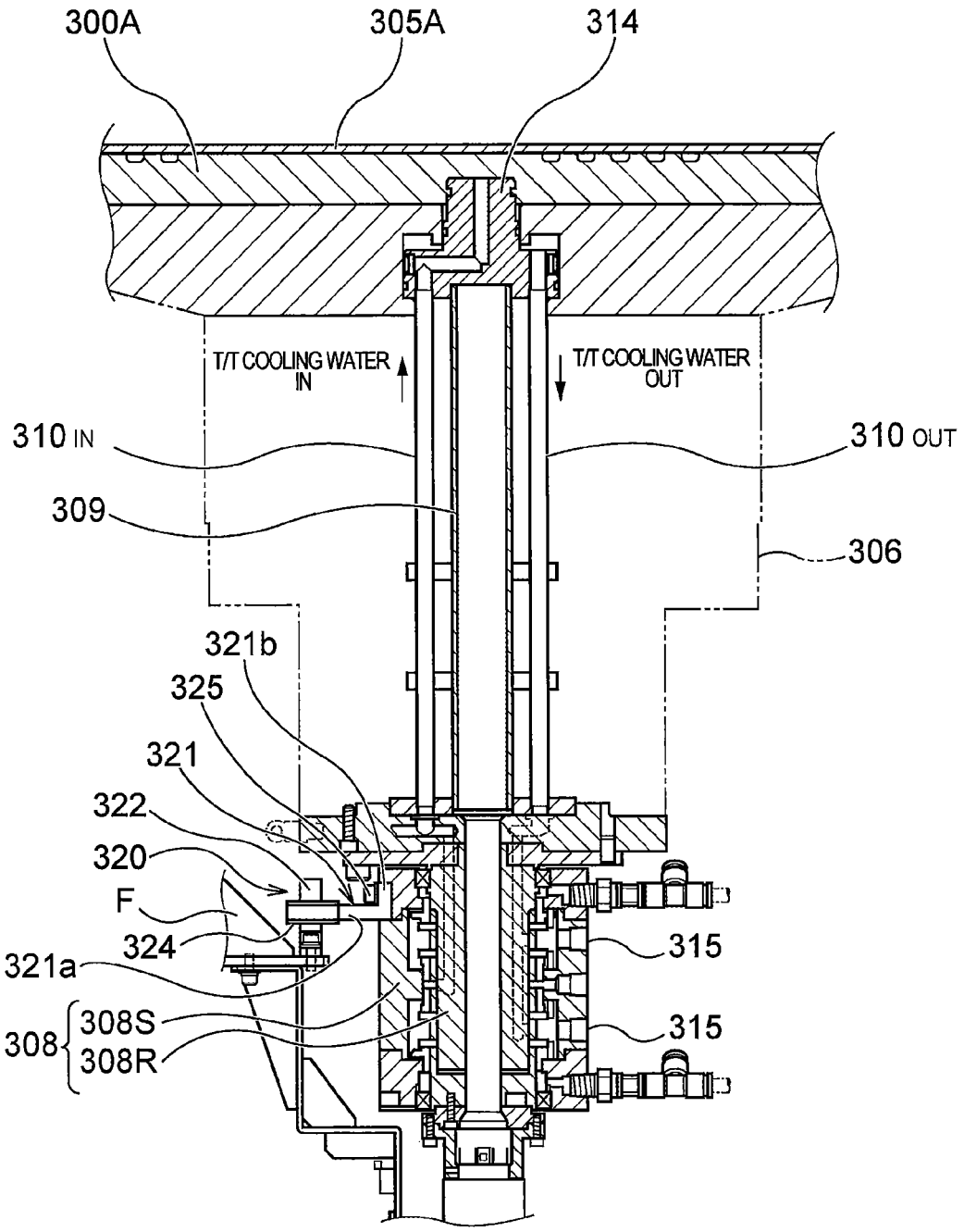
FIG. 3 is a cross-sectional view showing details of a table shaft and a rotary joint in a polishing table.

FIG. 3 is a cross-sectional view showing details of the interior of the polishing table 300A and the rotary joint 308. As shown in FIG. 3, a conduit 309 for housing conducting wires and the like to supply a power source and signals to devices (not shown) such as sensors provided at a lower portion of the polishing table 300A, and cooling water pipes $310_{IN}$, $310_{OUT}$ for cooling the polishing table are disposed in the table shaft 306. The upper end of the conduit 309 and the upper ends of the cooling water pipes $310_{IN}$ and $310_{OUT}$ are connected to a fixed joint 314, and the lower end of the conduit 309 and the lower ends of the cooling water pipes $310_{IN}$ and $310_{OUT}$ are connected to the rotary joint 308. The rotary joint 308 comprises an inner rotary ring 308R which rotates in unison with the table shaft 306, and an outer stationary ring 308S which is fixedly provided. The conduit 309 and the cooling water pipes $310_{IN}$ and $310_{OUT}$ are connected to the rotary ring 308R, and connecting ports 315 for external pipes for supplying a liquid such as cooling water from the outside are provided in the stationary ring 308S. The stationary ring 308S of the rotary joint 308 is coupled to an apparatus frame F through a rotation-prevention mechanism 320. The rotation-prevention mechanism 320 comprises a rotation-prevention plate 321 fixed to the stationary ring 308S of the rotary joint 308, and a stopper plate 322 fixed to the apparatus frame F. The rotation-prevention plate 321 and the stopper plate 322 are coupled to each other by a damper rubber 324 or a link mechanism (described below).

Figure 4:
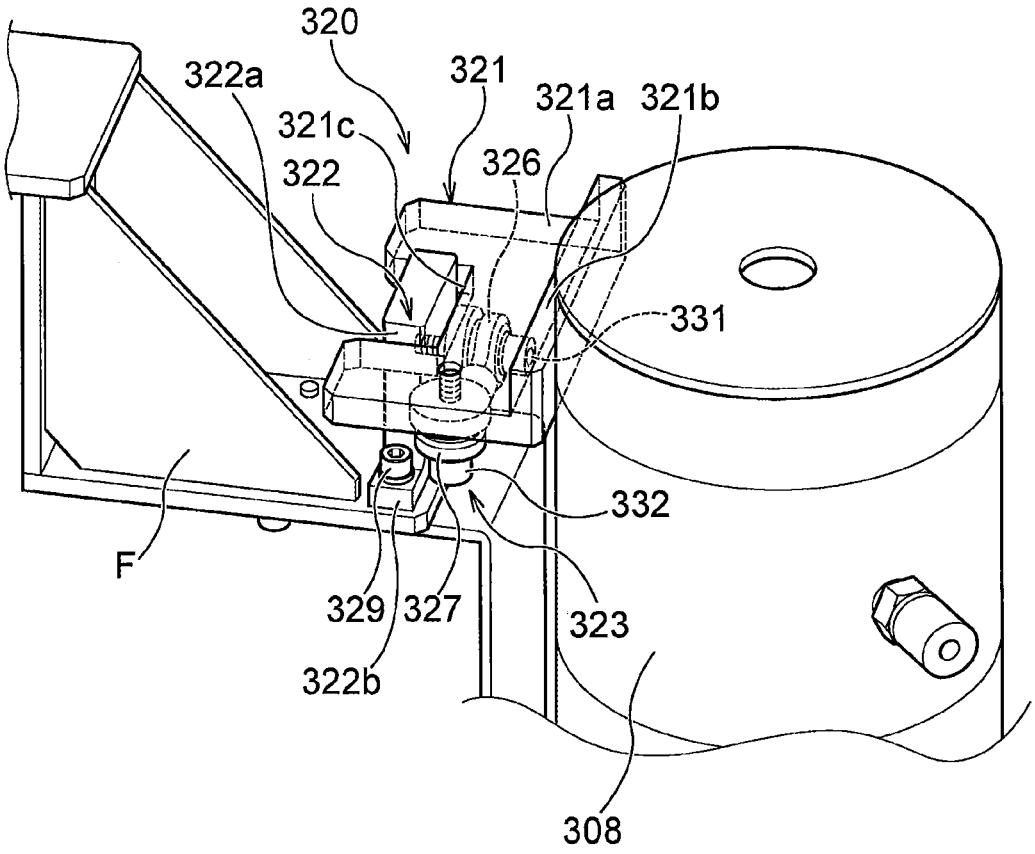
FIG. 4 is a view showing details of a rotation-prevention mechanism of the rotary joint shown in FIG. 3, and is a perspective view showing the rotary joint, the rotation-prevention mechanism, and an apparatus frame.
Figure 5:
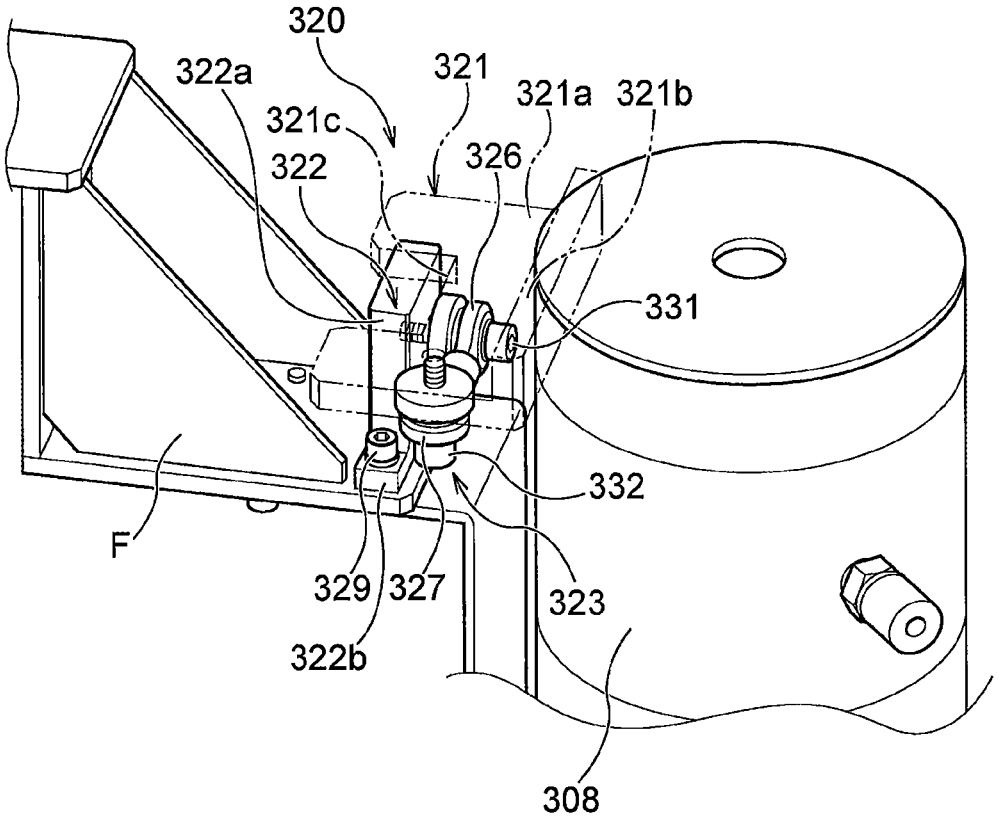
FIG. 5 is a view showing details of the rotation-prevention mechanism of the rotary joint shown in FIG. 3, and is a perspective view showing the rotary joint, the rotation-prevention mechanism, and the apparatus frame.

FIGS. 4 through 7B are views showing details of the rotation-prevention mechanism 320 of the rotary joint 308 shown in FIG. 3. FIGS. 4 and 5 are perspective views each showing the rotary joint 308, the rotation-prevention mechanism 320, and the apparatus frame F. Although the rotation-prevention plate 321 is shown by solid lines in FIG. 4, the rotation-prevention plate 321 is shown by imaginary lines in FIG. 5 to show the link mechanism 323 clearly.

As shown in FIGS. 4 and 5, the rotation-prevention mechanism 320 comprises the rotation-prevention plate 321 fixed to the rotary joint 308, the stopper plate 322 fixed to the apparatus frame F, and the link mechanism 323 for coupling the rotation-prevention plate 321 and the stopper plate 322.

The rotation-prevention plate 321 has a horizontal plate portion 321*a* extending in a horizontal direction and a bent portion 321*b* bent upward from the horizontal plate portion 321*a*, and the bent portion 321*b* is fixed to a side surface of the rotary joint 308 by bolts 325 (see FIG. 3). The stopper plate 322 comprises a plate-like body portion 322*a* provided vertically from the apparatus frame F, and flange portions 322*b* formed on both side portions of the lower end of the body portion 322*a* (in FIGS. 4 and 5, only one of the flange portions 322*b* is shown). Each of the flange portions 322*b* is fixed to the apparatus frame F by a bolt 329, thereby fixing the stopper plate 322 to the apparatus frame F. An upper part of the body portion 322*a* of the stopper plate 322 is housed in a recessed portion 321*c* formed in the horizontal plate portion 321*a* of the rotation-prevention plate 321. The link mechanism 323 which couples the rotation-prevention plate 321 and the stopper plate 322 comprises a spherical plain bearing 326 with female thread fixed to the stopper plate 322 and a spherical plain bearing 327 with male thread connected to the spherical plain bearing 326 with female thread.

A bolt 331 extending in a horizontal direction is inserted into a hole of the spherical plain bearing 326 with female thread, and a threaded part of the bolt 331 is screwed into the stopper plate 322, thereby fixing the spherical plain bearing 326 with female thread to the stopper plate 322. A bolt 332 extending in the vertical direction is inserted into a hole of the spherical plain bearing 327 with male thread, and a threaded part of the bolt 332 is screwed into the rotation-prevention plate 321, thereby fixing the spherical plain bearing 327 with male thread to the rotation-prevention plate 321.

Figure 6:
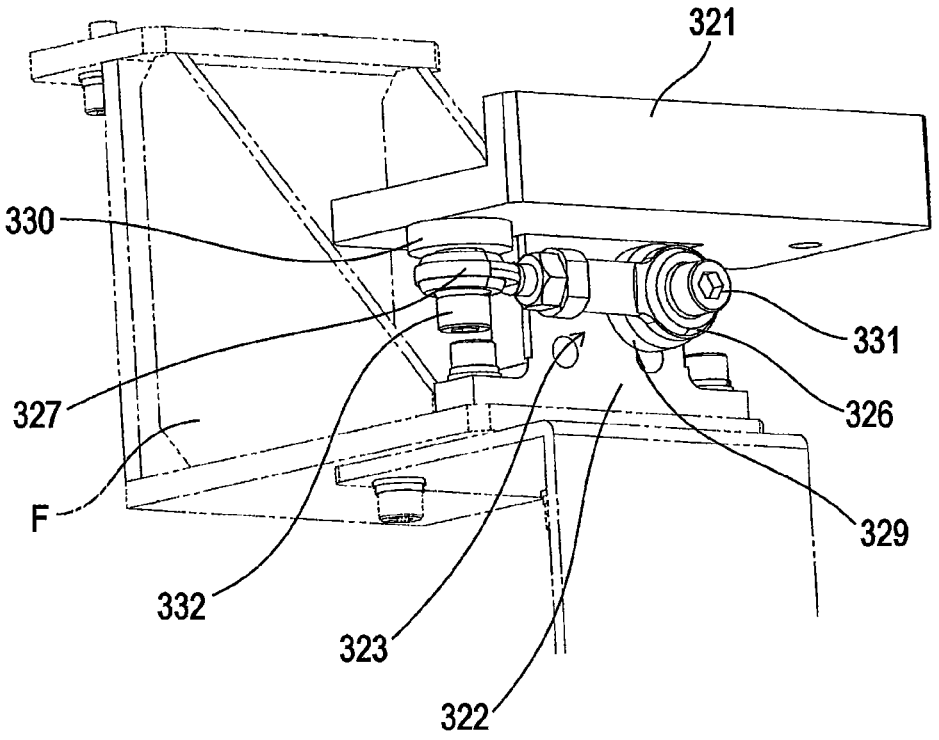
FIG. 6 is a view showing details of a rotation-prevention mechanism of the rotary joint shown in FIG. 3, and is a perspective view showing details of a link mechanism for coupling a rotation-prevention plate and a stopper plate.

FIG. 6 is a perspective view showing details of the link mechanism 323 for coupling the rotation-prevention plate 321 and the stopper plate 322. As shown in FIG. 6, the spherical plain bearing 326 with female thread is fixed to the stopper plate 322 by the bolt 331. A spacer 329 comprising a metal washer is interposed between the stopper plate 322 and the spherical plain bearing 326 with female thread. The spherical plain bearing 327 with male thread is fixed to the rotation-prevention plate 321 by the bolt 332. A spacer 330 comprising a metal washer is interposed between the rotation-prevention plate 321 and the spherical plain bearing 327 with male thread.

Figure 7A:
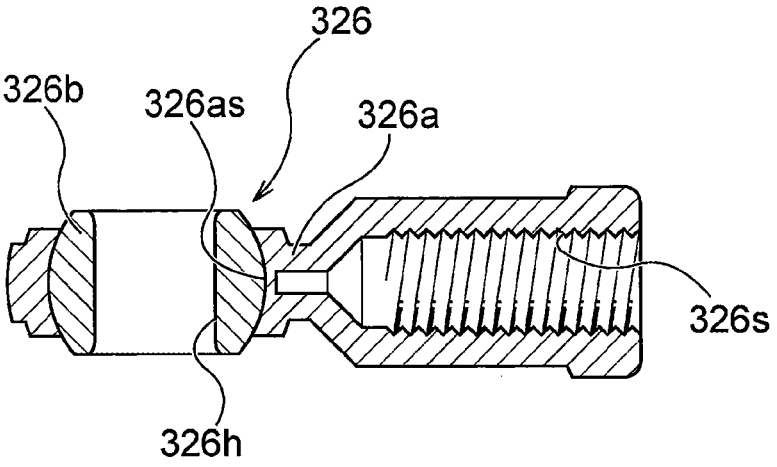
FIGS. 7A and 7B are views showing details of the rotation-prevention mechanism of the rotary joint shown in FIG. 3, and are views showing a spherical plain bearing with female thread and a spherical plain bearing with male thread, respectively.
Figure 7B:
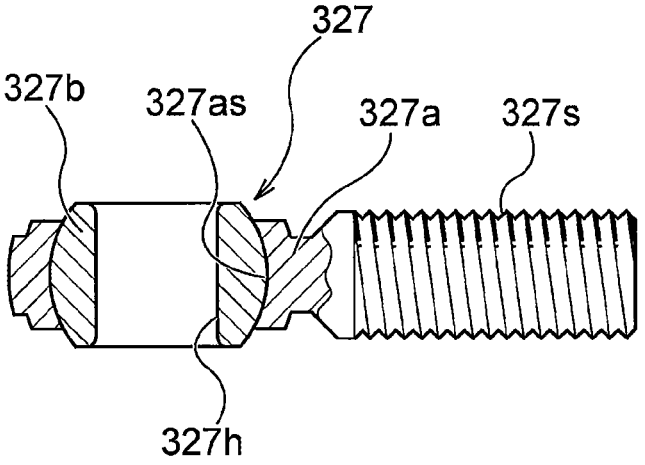

FIGS. 7A and 7B are views showing the spherical plain bearing 326 with female thread and the spherical plain bearing 327 with male thread, respectively. FIG. 7A is a cross-sectional view showing the spherical plain bearing 326 with female thread and FIG. 7B is a cross-sectional view showing the spherical plain bearing 327 with male thread.

As shown in FIG. 7A, the spherical plain bearing 326 with female thread comprises a body part 326*a* having a female thread 326*s*, and a spherical inner ring 326*b* fitted with a concave spherical surface 326 as of the body part 326*a*. The bolt 331 is inserted into a hole 326*h* formed in the spherical inner ring 326*b*, and thus the spherical plain bearing 326 with female thread is fixed to the stopper plate 322.

As shown in FIG. 7B, the spherical plain hearing 327 with male thread comprises a body part 327*a* having a male thread 327*s*, and a spherical inner ring 327*b* fitted with a concave spherical surface 327 as of the body part 327*a*. The bolt 332 is inserted into a hole 327*h* formed in the spherical inner ring 327*b*, and thus the spherical plain bearing 327 with male thread is fixed to the rotation-prevention plate 321. The male thread 327*s* of the spherical plain bearing 327 with male thread is screwed into the female thread 326*s* of the spherical plain bearing 326 with female thread to integrate the spherical plain bearing 326 with female thread and the spherical plain bearing 327 with male thread, which constitute the link mechanism 323. Therefore, the link mechanism 323 is made up of a metal material having high rigidity.

As shown in FIGS. 4 through 7B, the rotary joint 308 is coupled to the apparatus frame F through the rotation-prevention mechanism 320. The rotation-prevention mechanism 320 comprises the link mechanism 323, which uses the two spherical plain bearings 326, 327. By this link mechanism 323 using the two spherical plain bearings 326, 327, the rotation-prevention plate 321 fixed to the stationary ring 308S of the rotary joint 308 and the stopper plate 322 fixed to the apparatus frame F are coupled to each other. In other words, the rotary joint 308 is coupled to the apparatus frame F by the link mechanism 323 of rod type with ball joint. With this configuration, the rotary joint 308 is prevented from being rotated and is supported by the apparatus frame F. Thus, a vibration phenomenon due to stick-slip generated on a seal contact surface between the stationary ring 308S and the rotary ring 308R in the rotary joint 308 can be absorbed or lessened by a micro rotational movement in all directions (360°) by the two spherical plain bearings 326, 327.

Figure 8:
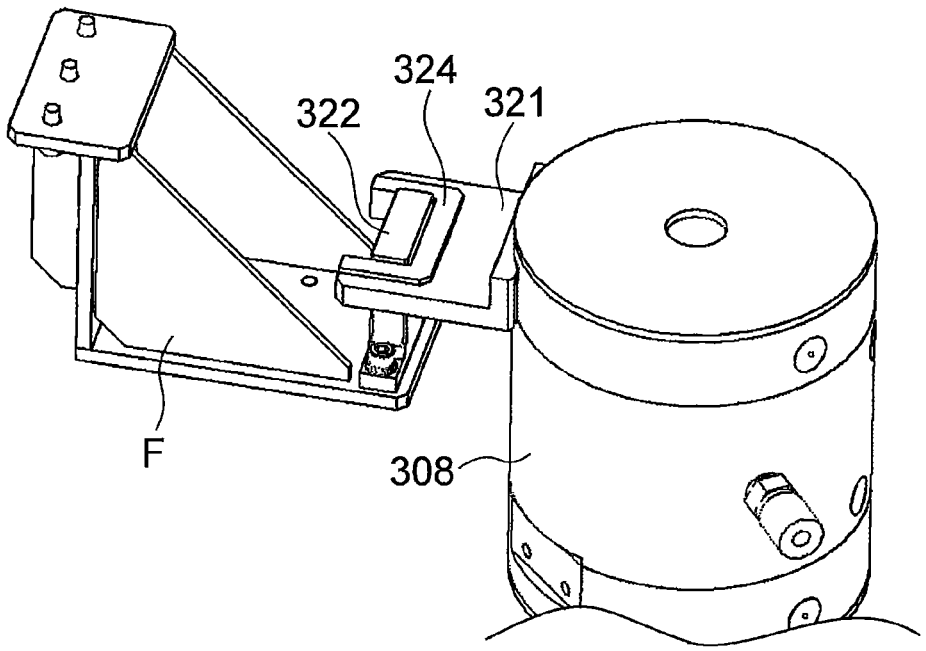
FIG. 8 is a perspective view showing the case where a cushioning mechanism comprising a damper rubber is employed as a mechanism for coupling the rotation-prevention plate connected to the rotary joint and the stopper plate connected to the apparatus frame F.

FIG. 8 is a perspective view showing the case where a cushioning mechanism comprising a damper rubber 324 is employed as a mechanism for coupling the rotation-prevention plate 321 connected to the rotary joint 308 and the stopper plate 322 connected to the apparatus frame F. As shown in FIG. 8, the damper rubber 324 is interposed between the rotation-prevention plate 321 and the stopper plate 322 so that the rotation-prevention plate 321 and the stopper plate 322 do not directly contact each other. The damper rubber 324 has a U-shaped planar shape so as to surround three surfaces of the stopper plate 322, and has substantially the same vertical thickness as the rotation-prevention plate 321.

Table 1 is a table showing characteristic values, i.e., natural frequencies (Hz) of respective parts in the case where the cushioning mechanism comprising the damper rubber 324 or the link mechanism 323 according to the embodiment is employed as the mechanism for coupling the rotation-prevention plate 321 connected to the rotary joint 308 and the stopper plate 322 connected to the apparatus frame F.

TABLE 1

| SPECIFICATION | CHARACTERISTIC VALUE Hz | 40 50 60 70 80 90 100 110 120 130 200 |
|---|---|---|
| ROTARY JOINT | 59.4 | |
| DAMPER RUBBER (RUBBER HARDNESS 70) | 50~59 | |
| DAMPER RUBBER (RUBBER HARDNESS 75-85) | 59~82 | |
| LINK MECHANISM OF EMBODIMENT | 204 | |
| COOLING WATER SHAFT (S2) | 47.8 | |
| COOLING WATER SHAFT (x) | 68.4 | |

As shown in Table 1, the rotary joint 308 has a natural frequency of 59.4 Hz, a cooling water pipe (cooling water shaft (S2)) has a natural frequency of 47.8, and a cooling water pipe (cooling water shaft (X)) has a natural frequency of 68.4. On the other hand, a damper rubber having rubber hardness of 70 (Duro) has a natural frequency of 50-59 Hz, and a damper rubber having rubber hardness of 75-85 (Duro) has a natural frequency of 59-82.

Thus, in the case where the cushioning mechanism comprising the damper rubber is used as a mechanism for coupling the rotation-prevention plate 321 and the stopper plate 322, under the condition where the damper rubber and the rotary joint have similar natural frequencies even if the hardness of the damper rubber is changed, the natural frequency (characteristic value) of the rotary joint cannot be changed by coupling the damper rubber to the rotary joint. Therefore, the rotary joint and peripheral parts such as a cooling water shaft resonate to generate torsional vibration in the rotary joint or to generate an abnormal sound at the engagement part between the cooling water shaft and the polishing table. However, vibration control may be achieved, provided that the damper rubber and the rotary joint have sufficiently different natural frequencies.

On the other hand, the link mechanism 323 of rod-type with ball joint which uses the two spherical plain bearings 326, 327 has a natural frequency of 204 Hz. In this manner, by connecting the link mechanism 323 having a natural frequency of 204 Hz with the rotary joint 308, a rotary joint assembly which integrates the rotary joint 308 and the link mechanism 323 has an increased natural frequency which is significantly different from the natural frequencies of other peripheral parts. Therefore, resonance between the rotary joint assembly, which integrates the rotary joint 308 and the link mechanism 323, and the peripheral parts such as a cooling water shaft can be prevented. As a result, the torsional vibration of the rotary joint can be prevented, and pipe wear and generation of the abnormal sound can be prevented.

Figure 9:
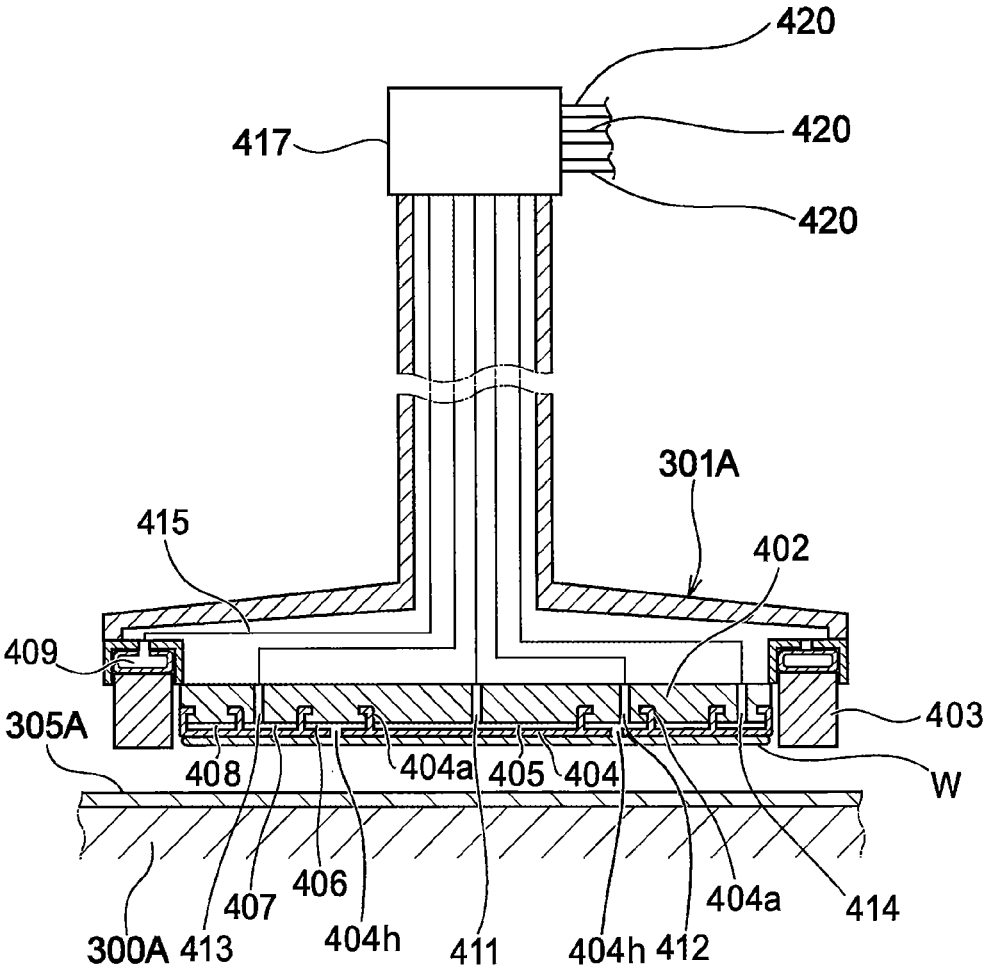
FIG. 9 is a view showing a top ring which is basically composed of a top ring body (which is also referred to as a carrier) for pressing a substrate against a polishing surface, and a retaining ring for directly pressing the polishing surface.

The rotation-prevention mechanism 320 of the rotary joint shown in FIGS. 4 through 7B can be applied also to the top ring. FIG. 9 is a schematic cross-sectional view showing a configuration of a main part of the top ring 301A of the first polishing unit 30A.

As shown in FIG. 9, the top ring 301A basically comprises a top ring body (which is also referred to as a carrier) 402 for pressing the substrate W against the polishing surface, and a retaining ring 403 for directly pressing the polishing surface. The retaining ring 403 is attached to a peripheral portion of the top ring body 402. An elastic membrane (membrane) 404, which is brought into contact with a rear face of the substrate, is attached to a lower surface of the top ring body 402.

The elastic membrane (membrane) 404 has a plurality of concentric partition walls 404*a*, which form a central chamber 405; a ripple chamber 406; an outer chamber 407; and an edge chamber 408 between the upper surface of the elastic membrane 404 and the lower surface of the top ring body 402. The elastic membrane (membrane) 404 has a plurality of holes 404*h* which pass through the elastic membrane in a thickness direction of the elastic membrane in the ripple area (ripple chamber 6). A flow passage 411 communicating with the central chamber 405, a flow passage 412 communicating with the ripple chamber 406, a flow passage 413 communicating with the outer chamber 407, and a flow passage 414 communicating with the edge chamber 408 are formed in the top ring 301A. The flow passage 411, the flow passage 412, the flow passage 413, and the flow passage 414 are connected via a rotary joint 417 to external pipes 420, respectively. A compression supply source is connected to the external pipes 420 via a pressure regulating unit, and a vacuum source is connected to the external pipes 420.

Further, a retaining ring pressure chamber 409, which is formed by an elastic membrane, is provided immediately above the retaining ring 403. This retaining ring pressure chamber 409 is coupled to the external pipe 420 through a flow passage 415 formed in the top ring body 402 and the rotary joint 417.

In the top ring 301A configured as shown in FIG. 9, the pressures of the fluid supplied to the central chamber 405, the ripple chamber 406, the outer chamber 407, the edge chamber 408, and the retaining ring pressure chamber 409 can be independently controlled by the pressure regulating unit. With this structure, forces of pressing the substrate W against the polishing pad 2 can be adjusted at respective local areas of the substrate, and a force of pressing the polishing pad 2 by the retaining ring 403 can be adjusted. Further, by connecting the ripple chamber 406 to the vacuum source, the substrate W can be attached to the elastic membrane 404 under vacuum.

The rotary joint 417 shown in FIG. 9 is coupled to the apparatus frame F by a mechanism which is the same as the rotation-prevention mechanism 320 shown in FIGS. 4 through 7B (not shown). Therefore, in the top ring side also, the torsional vibration of the rotary joint 417 can be prevented, and pipe wear and generation of an abnormal sound can be prevented.

Although the embodiments of the present invention have been described herein, the present invention is not intended to be limited to these embodiments. Therefore, it should be noted that the present invention may be applied to other various embodiments within a scope of the technical concept of the present invention.

What is claimed is:

1. A polishing apparatus for polishing a substrate by pressing the substrate against a polishing surface on a polishing table by a top ring while rotating the top ring which holds the substrate and rotating the polishing table, the polishing apparatus comprising:

a rotary joint comprising an inner rotary ring and an outer stationary ring, the inner rotary ring being fixed to a rotating part of the polishing table or a rotating part of the top ring to supply a fluid into the polishing table or the top ring and discharge the fluid from the polishing table or the top ring; and a rotation-prevention mechanism which connects the outer stationary ring of the rotary joint with an apparatus frame to prevent the outer stationary ring of the rotary joint from being rotated;

wherein the rotation-prevention mechanism comprises a link mechanism having at least one spherical plain bearing.

2. The polishing apparatus according to claim 1, wherein the link mechanism comprises two spherical plain bearings which are connected to each other.

3. The polishing apparatus according to claim 2, wherein one of the two spherical plain bearings comprises a spherical plain bearing with male thread, and the other of the two spherical plain bearings comprises a spherical plain bearing with female thread, and the two spherical plain bearings are integrated by screw fastening.

4. The polishing apparatus according to claim 1, wherein the rotation-prevention mechanism comprises the link mechanism, a rotation-prevention plate configured to connect the link mechanism with the outer stationary ring of the rotary joint, and a stopper plate configured to connect the link mechanism with the apparatus frame.

5. The polishing apparatus according to claim 1, wherein the link mechanism is connected with the outer stationary ring of the rotary joint to increase a natural frequency of the rotary joint, whereby the natural frequency of the rotary joint is different from a natural frequency of a rotating member of the polishing table or a rotating member of the top ring.

6. The polishing apparatus according to claim 5, wherein the rotating member of the polishing table comprises a cooling water pipe provided in a table shaft to be connected to the inner rotary ring of the rotary joint and configured to supply cooling water into the polishing table or to discharge the cooling water from the polishing table.

* * * * *